United States Patent [19]

Marks

[11] 4,089,436

[45] May 16, 1978

[54] REFRIGERATOR ICE DOOR MECHANISM

[75] Inventor: Edwin Morrison Marks, Evansville, Ind.

[73] Assignee: Whirlpool Corporation, Benton Harbor, Mich.

[21] Appl. No.: 718,147

[22] Filed: Aug. 26, 1976

[51] Int. Cl.[2] ..... B67D 5/06

[52] U.S. Cl. ..... 222/70; 221/15; 49/29; 62/344; 222/556

[58] Field of Search ..... 222/70, 505, 556, 146; 62/344; 221/15, 16, 12, 13, 154, 150, 247–250; 251/48, 49; 220/260; 49/29, 30, 386; 141/360–362

[56] References Cited

U.S. PATENT DOCUMENTS

| | | | |
|---|---|---|---|
| 2,697,918 | 12/1954 | Comstock | 62/345 |
| 2,957,607 | 10/1960 | Smith | 222/146 C |
| 3,548,444 | 12/1970 | Jacobus et al. | 16/78 |
| 3,572,053 | 3/1971 | Jacobus et al. | 62/344 |
| 3,640,088 | 2/1972 | Jacobus et al. | 62/344 |
| 3,942,334 | 3/1976 | Pink | 62/266 |

*Primary Examiner*—Robert B. Reeves
*Assistant Examiner*—H. Grant Skaggs
*Attorney, Agent, or Firm*—Wegner, Stellman, McCord, Wiles & Wood

[57] ABSTRACT

A refrigerator ice door mechanism having improved structure for controlling the outlet opening of a delivery chute provided for deliverying ice pieces from an ice maker within the refrigerator to an access space in the front of the door with minimum opening of the outlet. The closure is continuously biased to a closed position while permitting ice pieces moving through the ice delivery chute to move the closure away from the opening in passing to the access space. A time delay device is provided for applying a sealing force to the closure to sealingly close the opening a predetermined period of time subsequent to termination of the ice piece delivery operation.

11 Claims, 5 Drawing Figures

36
34
35
36a
48
37
38
51
50
52
53
49
39
66
33
28a
40
30
42
43
41
31
28
57
58
46
54
65
47
60
64
63
62
61
56
45

REFRIGERATOR ICE DOOR MECHANISM

BACKGROUND OF THE INVENTION

1. Field of the Invention

This invention relates to ice piece dispensers and in particular to means for controlling the closure of ice piece delivery opening in the wall of a refrigerator having an automaic ice piece dispenser.

2. Description of the Prior Art

In one form of known ice piece dispenser, an ice piece maker is disposed within the freezer compartment of a refrigeration apparatus. The ice pieces are delivered to an access space in the front of the acesss door of the apparatus through a delivery chute receiving the ice pieces from the ice piece maker and delivering them through the door to the access space.

Conventionally, in such dispensing apparatus, delivery operation is effected by engagement of a receiving receptacle, such as a cup or glass, with an actuator mounted at the access space below the delivery chute opening so that when the receptacle is engaged with the actuator, the ice pieces are cuased to be delivered downwardly thereinto, with the delivery operation continuing until the user withdraws the receptacle from engagement with the actuator.

The delivery chute conventionally defines an opening through the refrigeration apparatus insulative wall means. Thus, it is desirable to close the chute other than during the delivery operation. One such closure is illustrated in U.S. Pat. No. 2,697,918 of Alfred E. Comstock. In the apparatus disclosed therein, the closure comprises a pivoted flap which is swung to an open position by a plunger rod operated by a bell crank, in turn actuated by a flexible cable connected to a crank on the end of a timing shaft. Each cycle of operation, the cable is tensioned to operate the bell crank and shift the plunger outwardly to open the discharge flap. As shown in FIG. 3 of the Comstock patent, the closure rests against the port means in the closed arrangement thereof.

Another form of through-the-door ice dispenser is illustrated in U.S. Pat. No. 3,572,053 of Dwight W. Jacobus et al. The dispenser in this patent differs from that of the Comstock patent in that one or more springs are provided to bias the closure to its normally closed position. A time delay means is provided for keeping the closure open a few seconds after the actuator rod returns to its forward position as by removal of the receptacle from engagement therewith.

John J. Pink, in U.S. Pat. No. 3,942,334, shows a door delay closing mechanism for an ice chute from a power driven ice dispenser in a freezer-refrigerator. The chute door is closed by a spring-loaded means. When the door opening lever is released, an inertial motor delays closing of the door until the chute is emptied of ice. Thus, in each of the Pink and Jacobus et al structures, means are provided for preventing the immediate closing of the door to provide sufficient time for the last delivered pieces of ice to pass downwardly from the chute at the end of the delivery operation.

In copending application of Robert E. Lindenschmidt, for U.S. patent, Ser. No. 718,146 , filed Aug. 26, 1976, which is owned by the assignee hereof, an improved structure for controlling the outlet opening is disclosed wherein the closure is swung to an open position away from the delivery chute opening as an incident of actuation of the dispenser. The closure is permitted to swing back to the blocking position upon release of the actuator, and is caused to sealingly close the chute opening after a preselected time delay.

SUMMARY OF THE INVENTION

The present invention comprehends an improved ice piece dispensing apparatus wherein the closure door is biased to effectively continuously block the delivery opening against free air flow therethrough while yet permits opening thereof by ice pieces being delivered through the chute.

In the illustrated embodiment, the closure door is gravity-biased to the blocking position.

Thus, the closure door effectively prevents free flow of warm air inwardly through the chute into the freezer compartment as may occur in the prior art devices which maintain the closure door open for a preselected period of time.

The ice piece dispensing apparatus of the present invention further includes means for effecting a positive sealing closure of the chute opening after a preselected delay period. Once this sealing has been effected, ice pieces delivered to the chute will no longer cause the closure door to open.

Thus, the present invention comprehends an improved dispensing apparatus wherein the delivery chute is effectively closed at all times other than when ice pieces are being delivered through the chute to effectively preclude undesirable delivery of warm air inwardly through the wall means defining the delivery chute to the ice maker compartment. The invention comprehends the effective closure of the chute opening releasably during the dispensing operation and nonreleasably subsequent thereto.

The effective minimizing of warm air delivery to the ice maker provides improved efficiency in the ice making operation and improved maintenance of the formed ice pieces as separate elements in the storage means thereof. As the mechanism permits effectively free delivery of all ice pieces being dispensed, there is no need for special configuration or arrangement of the structure to prevent jamming of such pieces as is required in the prior art devices.

Thus, the ice piece dispensing apparatus of the present invention is extremely simple and economical of construction while yet providing the improved ice piece dispensing functioning discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 4:
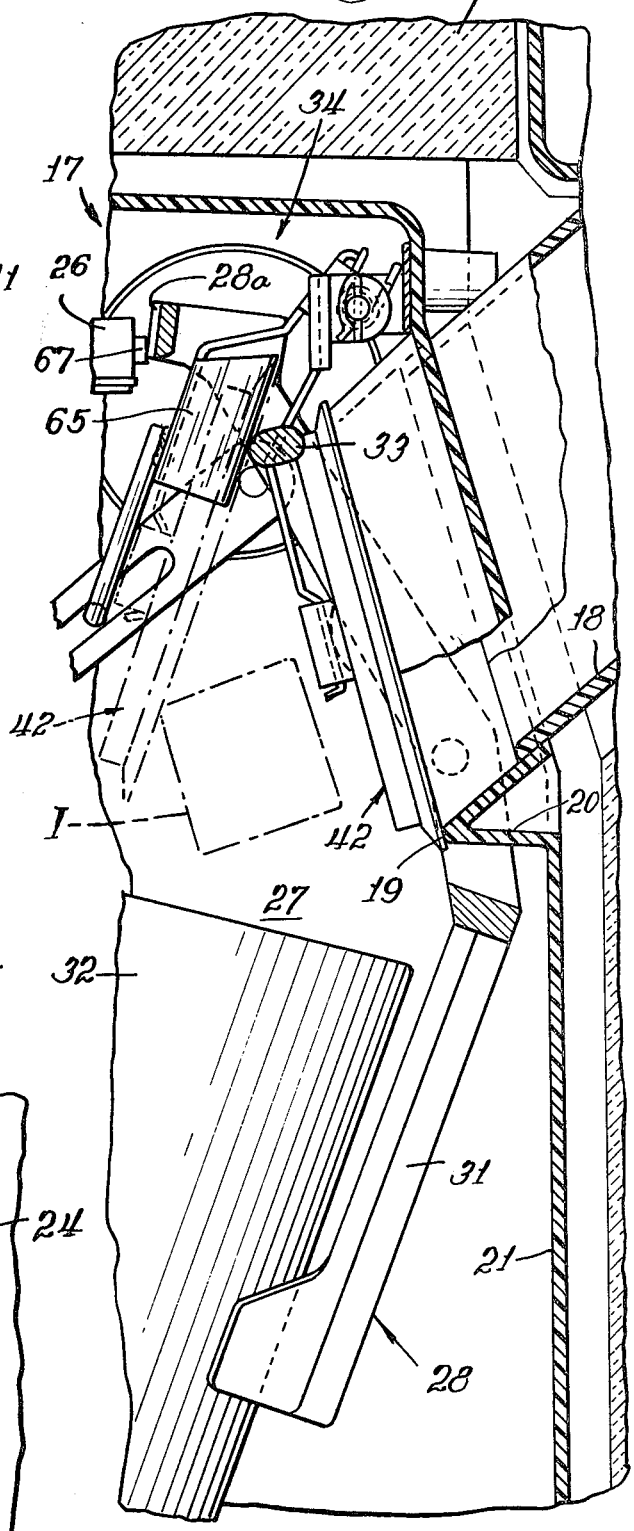
FIG. 4 is a fragmentary enlarged vertical section taken substantially along the line 4—4 of FIG. 3, and illustrating the arrangement of the dispensing apparatus during a dispensing of an ice piece in broken lines.

In the exemplary embodiment of the invention as disclosed in the drawing, a refrigeration apparatus generally designated 10 is shown to comprise a side-by-side apparatus having an above-freezing portion 11 and a freezer portion 12. Portions 11 and 12 are provided with suitable front doors 13 and 14, respectively. Freezer door 14 may be provided with a through-the-door dispensing means generally designated 15 including a refrigerated water dispenser 16 and an ice piece dispenser 17. As shown in FIG. 4, door 14 is provided with a downwardly, forwardly inclined delivery chute 18 defining an outer opening 19 through which ice pieces I may be dispensed in controlled dispensing operation. Opening 19 is defined by a wall portion 20 of the rear wall 21 of the dispensing means 15 effectively defining a forward extension portion of the chute 18.

Figure 1:
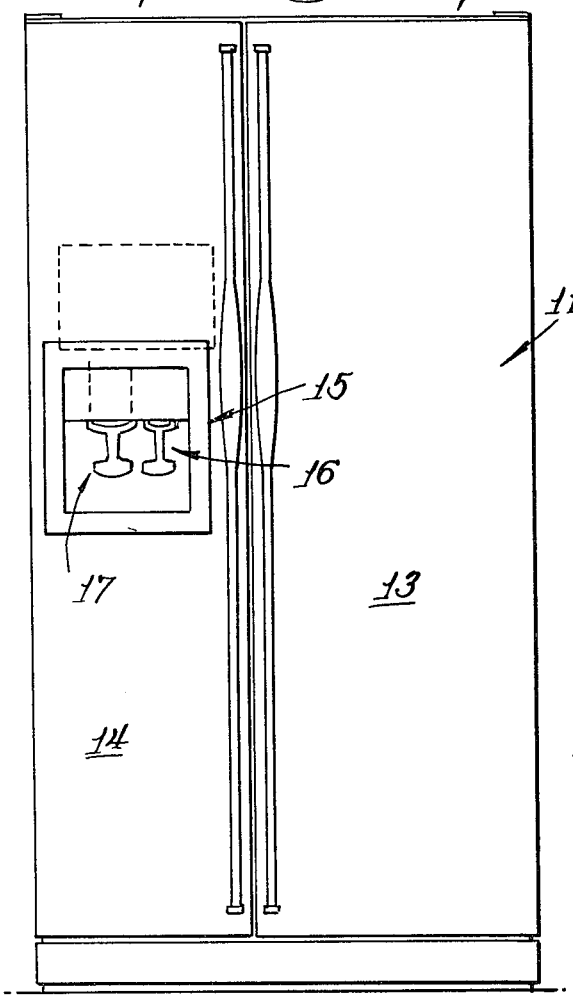
FIG. 1 is a front elevation of a refrigeration apparatus having an ice piece dispensing means embodying the invention.
Figure 2:
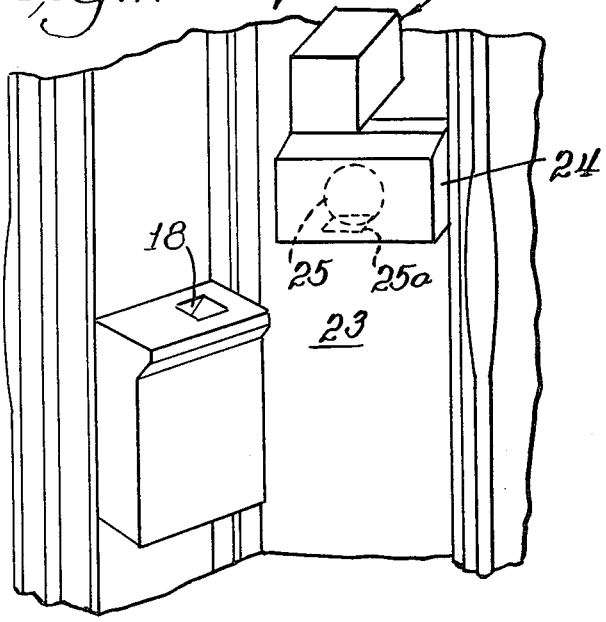
FIG. 2 is a fragmentary perspective view illustrating the provision of the ice maker apparatus in the freezer compartment of the refrigeration apparatus and the mounting of the dispensing structure on the freezer door thereof.

As shown in FIG. 2, the ice pieces may be formed in an ice maker generally designated 22 mounted in the freezer compartment 23 of the freezer portion 12. The freezer compartment includes a collecting bin 24 which stores the ice pieces and delivery means 25 adjacent the bin 24 for selective delivery to the dispensing means 15 through an outlet **25*a* opening into chute 18. Suitable electrically operated mechanism (not shown) responsive to actuation by a delivery control switch 26 in the dispenser 17 is provided to operate delivery means 25 to effect selective, generally sequential delivery of ice pieces from the delivery means 25 downwardly through chute 18 to the access space 27 defined by the dispensing means 15**.

Switch 26, as illustrated in FIG. 4, is closed by the engagement of a shoulder portion **28*a* of an actuator 28 pivotally mounted to a pair of supports 29 by a corresponding pair of pivots 30**.

Figure 3:
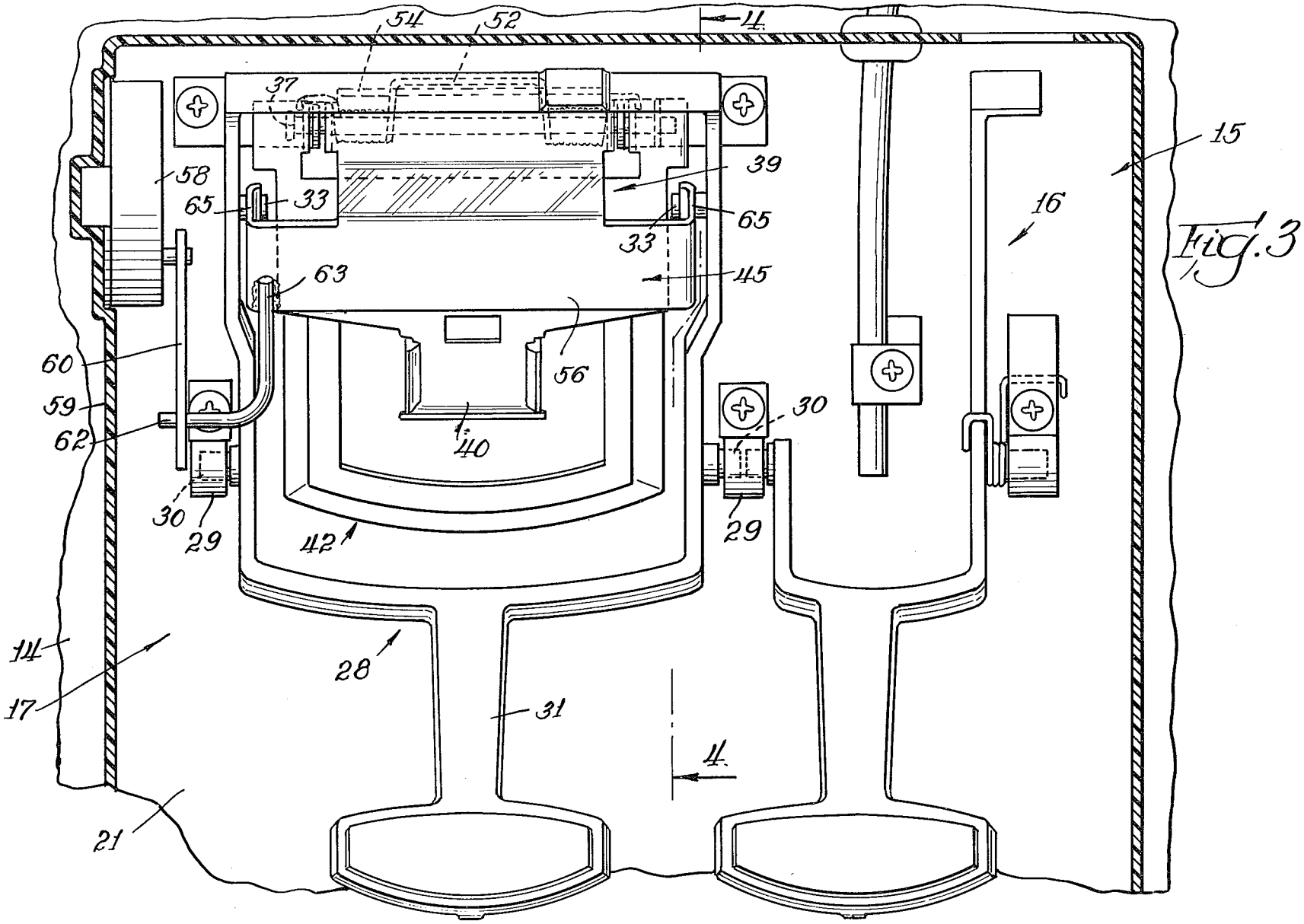
FIG. 3 is a fragmentary enlarged front elevation of the dispensing structure in the access opening of the door.

As best seen in FIGS. 3 and 4, the actuator further includes a lower tongue 31 adapted to be engaged by a receptacle, such as a cup or glass, 32. The actuator further includes a pair of inwardly projecting shoulder portions, or lugs 33.

Figure 5:
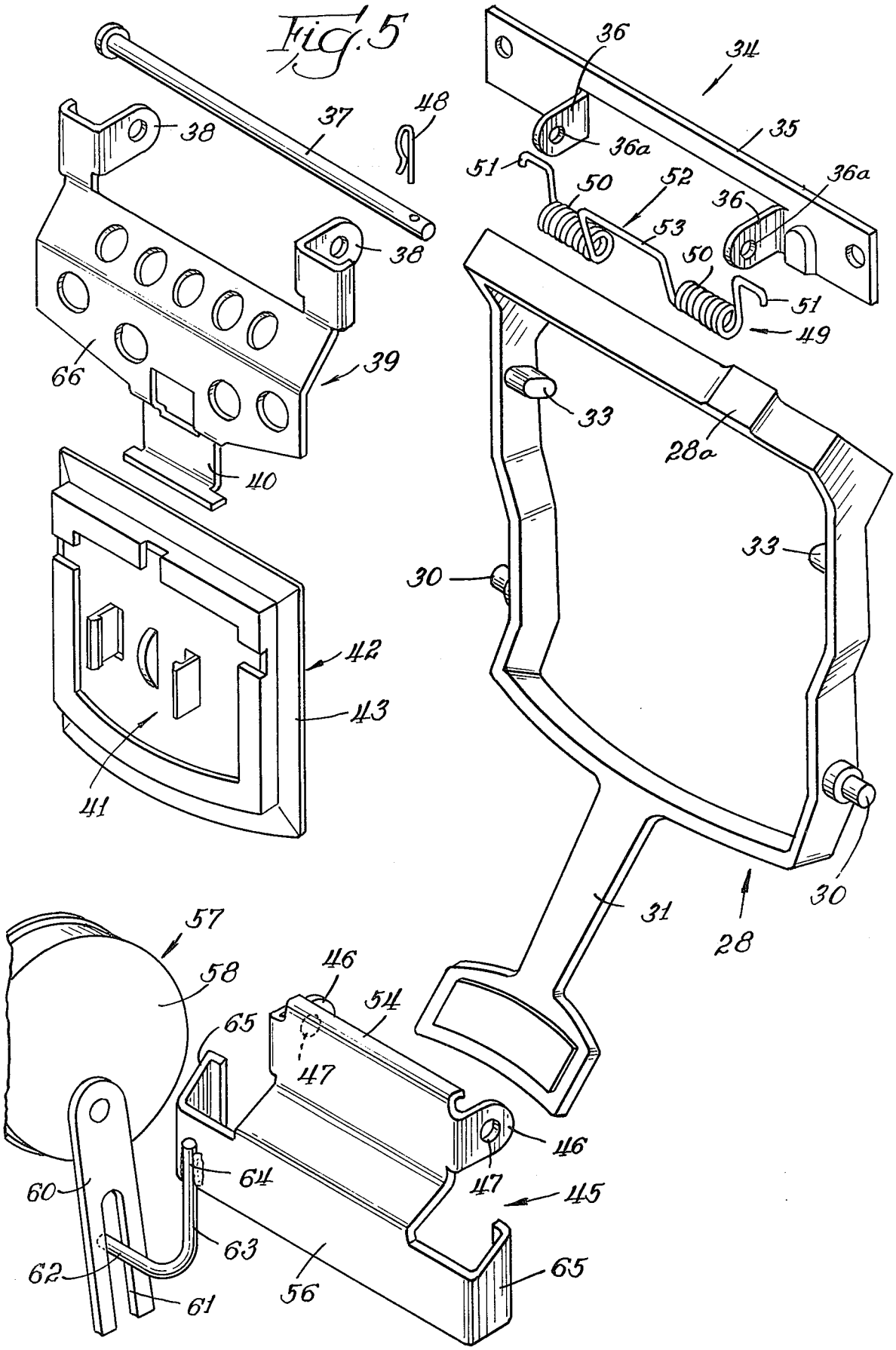
FIG. 5 is an exploded view of the closure mechanism.

Actuator 28 forms a portion of a closure control mechanism generally designated 34, which, in addition to providing means for automatically operating the control switch 26, also functions to provide a selective closing of the discharge chute opening 19 so as to effectively continuously prevent undesirable reverse warm air flow upwardly through the chute other than when ice pieces are passing downwardly therethrough. As shown in FIG. 5, mechanism 34 further includes a mounting bracket 35 adapted to be mounted to the rear wall 21 of dispenser 15 and provided with a pair of forwardly projecting lugs 36 adapted to support a mounting rod 37 which, in turn, is received in a pair of lugs 38 of a carrier 39 having a lower mounting portion 40 adapted to engage a mounting structure 41 of a closure generally designated 42. The closure includes a resilient pad portion 43 adapted to be engaged with the wall portion 20 defining the front opening of chute 18 when the closure is in the closed position of FIG. 4.

Mechanism 34 further includes a follower, or force-applying portions generally designated 45 having a pair of lugs 46 pivotally mounted on rod 37. In the illustrated embodiment, lugs 38 of carrier 39 are disposed outwardly of lugs 36 on bracket 35 and lugs 46 of follower 45 are disposed inwardly thereof whereby the carrier 39 and follower 45 are coaxially pivotally mounted about the axis of rod 37. Rod 37 may be removably secured to extend through suitable openings 36a in lugs 36, by means of a spring fastener 48.

A biasing spring 49 is provided with a pair of spaced helical portions 50 adapted to be mounted on rod 37 inwardly of the lugs 46 of follower 45. The opposite ends 51 of the spring define turned portions adapted to engage the bracket 35 and the midportion 52 of the spring comprises a U-shaped portion having a bight 53 adapted to engage a semicylindrical lip 54 of the follower 45. As shown in FIG. 5, the lip 54 is above the axis of the openings 47 in lugs 46, and thus the spring 49 tends to pivot the follower in a counterclockwise direction, as seen in FIG. 4, so as to move a lower force-transmitting portion 56 of the follower rearwardly.

The force-applying means further includes conventional time delay means generally designated 57 comprising a housing 58 mounted to the side wall 59 of dispenser 15 (FIG. 3), and having a drive arm 60 provided with a slot 61 receiving the turned end 62 of a connecting rod 63 having an opposite end 64 fixedly secured to the follower portion 56.

As further shown in FIG. 5, the follower 45 is provided with a pair of side flanges 65.

In the assembled arrangement of the mechanism 34, follower portion 56 overlies the midportion 66 of the carrier against which it is urged by the action of spring 49. Lugs 33 of the actuator 28 are adapted to engage the follower flanges 65 when the actuator is pivoted on pivots 30 in a counterclockwise direction, as seen in FIG. 5, to urge the lugs 33 forwardly against the flanges 65 and, thus, urge follower 45 away from closure 42. Forward movement of the follower portion 56, in turn, is transmitted through the connecting rod 63 to the time delay drive arm 60 so as to cock the time delay mechanism 57.

As the engagement between follower portion 56 and carrier portion 66 is readily separable, carrier 39 and closure 42 carried thereby are biased continuously downwardly, as by the gravity bias thereof. Upon return of the follower 45 from the forward position under the controlled functioning of the time delay mechanism 57, the closure is forcibly engaged with wall portion 20 to sealingly close opening 19.

Thus, as seen in FIG. 4, in the normal nondispensing arrangement of dispensing means 15, the actuator tongue 31 extends downwardly forwardly and the lugs 33 are disposed rearwardly to permit spring 49 to urge the follower rearwardly against the closure 42.

Referring to FIG. 4, when a cup, or similar receptacle, 32 is urged rearwardly against actuator tongue 31, the actuator pivots on pivots 30 in a counterclockwise direction as seen therein to urge the lugs 33 forwardly against flanges 65 of follower 45, thereby swinging the follower on rod 37 in a clockwise direction to cause connecting rod 63 to swing timer arm 60 in a clockwise direction to cock timer mechanism 57 and thus lugs 33 define positioning means for positioning the force-applying means in the retracted position as a result of such movement of the actuator tongue by the cup Concurrently, actuator portion **28*a* engages the switch actuator 67 to suitably operate switch 26 to effect delivery of ice pieces from the collecting bin to the opening 25*a* thereof and into chute 18 for delivery of the ice pieces I downwardly through the chute 18 and front opening 19 into the subjacent receptacle 32. Closure 42 and carrier 39** are designed and disposed such that, although during a dispensing operation the closure 42 hangs by gravity in a position which blocks front opening 19, the closure is easily moved outward momentarily to the open position illustrated by the dashed lines in FIG. 4 whenever an ice piece impacts against its rear surface. To this end, the carrier and closure are constructed to be lightweight, the carrier being provided with a series of apertures 66 for this purpose.

Upon removal of the receptacle from actuator tongue 31 lugs 33 are allowed to become spaced from follower 45 which is thusly permitted by the timer mechanism 57 which effectively defines a second portion of the positioning means for controlled positioning of the force-applying means to slowly return rearwardly until it contacts carrier 39 and comes to rest. Thus, any last ice pieces may freely swing the closure 42 to the open position permitting the last ice pieces to be dispensed downwardly into the receptacle 32 before it is fully withdrawn from the access space 27. The free swinging of the closure by the ice pieces helps assure a proper delivery thereof into the receptacle notwithstanding its being moved forwardly from the access space at this time.

As soon as an ice piece passes to below closure 42, the closure will again swing to the blocking position, shown in full lines in FIG. 4.

Timer 57 immediately starts moving the follower back toward the full line sealing position of FIG. 4 upon release of the actuator by driving the arm 60 in a counterclockwise direction, as seen in FIG. 4. The timer is arranged to provide a preselected time period in effecting this movement so as to permit all ice pieces to be suitably dispensed prior to the forceful sealing engagement of the closure 42 with the opening wall means 20.

As further shown in FIG. 4, the swinging of the closure by the ice piece I away from the blocking position is somewhat controlled so as to cause the closure 42 to deflect the ice piece rapidly downwardly toward the receptacle 32 as it is being withdrawn to provide a futher improved dispensing operation.

Resilient pad 43 of the closure 42 provides an effectively positive sealed closure of the opening 19 in the nondispensing arrangement of the apparatus, as shown in FIG. 4. While the closure, during a dispensing operation, is not urged to a sealed condition by the spring 49, the closure continues to effectively block reverse warm air flow upwardly through the chute 18 at this time so that the chute is open to atmosphere only during such times as when ice pieces are actually being dispensed through opening 19. Thus, minimum warm air flow into the freezer compartment 23 occurs in the automatic dispensing of the ice pieces by dispenser 15 to provide an improved functioning of the refrigeration apparatus 10 as discussed above.

In the illustrated embodiment, the closure is gravity-biased to the blocking position of FIG. 6. As will be obvious to those skilled in the art, the closure may be suitably spring biased to provide a releasable blocking of the chute opening 19 if desired. Thus, each of the structural arrangement providing for gravity biasing or spring biasing of the closure defines suitable means for continuously biasing the closure to close opening 19.

Another advantage of the present structure is the fail-safe arrangement of the closure which effectively assures a closing of the chute notwithstanding a failure of operation of the time delay mechanism.

Closure 42 thusly defines an improved ice chute door which is opened by ice pieces passing downward through the opening 19 of chute 18. The door is gravity-biased to a blocking position to effectively close the chute to room air while yet permitting ice pieces to freely move the door away from the blocking position to permit these ice pieces to be dispensed into the cup or glass in the vicinity of the actuator. The closure is arranged to be effectively positively sealingly closed after a preselected period of time to provide further improved sealed closure of the freezer compartment in the normal nondispensing arrangement of the apparatus.

The foregoing disclosure of specific embodiments is illustrative of the broad inventive concepts comprehended by the invention.

Having described the invention, the embodiments of the invention in which an exclusive property or privilege is claimed are defined as follows:

1. In an ice piece dispensing apparatus having means defining an opening through which ice pieces are delivered in a dispensing operation, the improvement comprising: a closure mounted adjacent said opening and being biased to a closed position wherein said closure effectively blocks air flow through said opening; closure control mechanism including a force-applying portion mounted adjacent said closure; positioning means for selectively disposing said force-applying portion in a released position spaced from said closure, and in a force-applying position, said force-applying portion in said force-applying position effectively positively urging said closure into sealed, closed relationship with said opening, and in said released position, permitting said closure to remain in said closed postion but be moved away from said opening by the ice pieces being delivered therethrough; and actuator means for causing said positioning means to dispose said force-applying portion in said released position upon initiation of an ice piece dispensing operation, and permitting said positioning means to allow said force-applying portion to return to said force-applying position after termination of the dispensing operation.

2. The ice piece dispensing apparatus of claim 1 wherein said closure is gravity-biased to said closed position.

3. The ice piece dispensing apparatus of claim 1 wherein said closure is swingably mounted.

4. The ice piece dispensing apparatus of claim 1 wherein ice piece delivery means are disposed adjacent said opening and provided with a control, said actuator means having a portion arranged to operate said delivery means control to initiate delivery of said ice pieces, said actuator means further including a shoulder portion engaging said force-applying portion to move said force-applying portion to said released position, said apparatus further including time delay means for disposing said force-applying portion in said force-applying position a preselected time subsequent to release of said force-applying portion by said actuator means shoulder portion.

5. The ice piece dispensing apparatus of claim 1 wherein said means defining the opening comprises a refrigeration apparatus access door.

6. In an ice piece dispensing apparatus having means defining an opening, the improvement comprising: closure means continuously biased to block the opening substantially against free air flow therethrough while permitting ice pieces to move the closure means momentarily away from the opening against the biasing thereof to permit dispensing of the ice pieces; delivery means selectively operable to cause generally sequential delivery of ice pieces through said opening; force-applying means for effectively positively urging said closure means sealingly across said opening; and time delay means permitting said force-applying means to urge said closure sealingly across said opening only after a predetermined period of time subsequent to operation of said delivery means.

7. The ice piece dispensing apparatus of claim 6 wherein said biasing means for comprises means gravity biasing the closure means to block said opening.

8. The ice piece dispensing apparatus of claim 6 wherein said force-applying means comprises spring means.

9. The ice piece dispensing apparatus of claim 6 wherein means are provided for imparting substantial kinetic energy to the ice pieces prior to movement thereof against the closure means to facilitate movement thereof by the ice pieces away from said opening.

10. The ice piece dispensing apparatus of claim 6 wherein said opening opens angularly downwardly and said closure means underlies said opening.

11. The ice piece dispensing apparatus of claim 6 wherein said closure is designed and disposed such that ice pieces passing through said opening impact the rear surface of said closure and thereby cause said closure to move away from said opening.

* * * * *